US005763025A

United States Patent [19]

Jones

[11] Patent Number: 5,763,025

[45] Date of Patent: Jun. 9, 1998

[54] PERSONAL ACCESSORY AND METHOD OF MAKING SAME

[76] Inventor: Lazetta Jones, 19132 Washburn, Detroit, Mich. 48221

[21] Appl. No.: 774,622

[22] Filed: Dec. 30, 1996

[51] Int. Cl.[6] ..... A63F 9/12

[52] U.S. Cl. ..... 428/33; 156/63; 273/153 R; 273/157 R; 428/52

[58] Field of Search ..... 428/7, 33, 52; 273/153 R, 157 R; 156/63

[56] References Cited

U.S. PATENT DOCUMENTS 3,682,479 8/1972 Miller et al. ..... 273/157 R 4,582,744 4/1986 Smyth, III ..... 428/542.2 X 5,341,634 8/1994 Straight ..... 63/4 X

*Primary Examiner*—Henry F. Epstein

*Attorney, Agent, or Firm*—Harness, Dickey & Pierce, P.L.C.

[57] ABSTRACT

A personalized accessory for ornamenting or otherwise accessorizing a person's clothing includes at least a first interlocking member and a second interlocking member. The first and second interlocking members are oriented so as to overlapped with respect to each other and are permanent affixed to one another. The personal accessory further includes a finding attached to at least one of the first and second interlocking members which serves as a means for mechanical attaching the personal accessory to a person or to a person's clothing.

13 Claims, 1 Drawing Sheet

PERSONAL ACCESSORY AND METHOD OF MAKING SAME

BACKGROUND OF THE INVENTION

1. Technical Field

The present invention relates generally to personal accessories for ornamenting or otherwise accessorizing a person's clothing. More particularly, the present invention relates to a personal accessory for ornamenting or otherwise accessorizing a person's clothing which is constructed of multiple overlapping pieces generally having an interlocking shape. The present invention also relates to a method of making such personal accessories.

2. Discussion

As is well known in the art, various types of personal accessories have been heretofore designed for ornamenting or otherwise accessorizing a person's clothing. Generally, such personal accessories are made by attaching various objects of visually interesting shape and/or color, such as jewels, beads, and the like to a jewelry finding. The finding functions as a mechanical means of attachment and varies in form depending upon the intended use of the personal accessory. For example, in situations where it is intended to accessorize a person's clothing by suspending the personal accessory from the person's ear (i.e., an earring), the provided finding can be in the form of a post for passing through a cooperating aperture in the ear or a clamp for engaging the lobe. Where it is desired to attach the personal accessory directly to the person's clothing, as with broaches and the like, the finding takes the form of a pin or other suitable structure.

While known personal accessories have proven to be commercially acceptable, each is attended with associated drawbacks and limitations. For example, known personal accessories are often limited in color by the available materials. In addition, known personal accessories are not capable of utilizing materials inexpensive and readily available materials. Furthermore, to a large extent, known personal accessories are often time consuming to assemble.

SUMMARY OF THE INVENTION

It is a principal object of the present invention to provide a personal accessory for ornamenting or otherwise accessorizing a person's clothing which is constructed from a plurality of interlocking puzzle pieces.

It is a related object of the present invention to provide a personal accessory for ornamenting or otherwise accessorizing a person's clothing which is of simple and inexpensive construction.

In one form, the present invention provides a personal accessory for ornamenting or otherwise accessorizing a person's clothing which includes a first interlocking member and a second interlocking member. The second interlocking member is attached to the first interlocking member. The personal accessory further includes means for releasably suspending the personal accessory from an article of clothing or directly from a person. The means for releasably attaching the personal accessory is permanently attached to at least one of the first and second interlocking members.

In a more preferred form, the present invention provides a personalized accessory for ornamenting or otherwise accessorizing a person's clothing, including at least a first piece from a jigsaw puzzle and a second piece from a jigsaw puzzle.

The first and second pieces from a jigsaw puzzle are oriented so as to be overlapped with respect to each other and are permanently affixed to one another. The personal accessory further includes a finding attached at least one of the first and second pieces from a jigsaw puzzle.

Another aspect of the present invention involves a method of making a personal accessory of the type described immediately above. The method involves the general steps of providing a first interlocking member, providing a second interlocking member, and attaching a finding to at least one of the first and second interlocking members. Preferably, the method further includes the step of overlapping the first and second interlocking members and permanently affixing the first and second interlocking members.

The objects set forth above and various other objects which further characterize the novelty of the present invention are pointed out with particularity in the detailed description which is provided below. Specifically, for a better understanding of the present invention, its advantages and objects obtained by its use, reference should be had to the drawings which form a further part hereof, and to the accompanying detail description, in which there is illustrated and described a preferred embodiment of the present invention.

BRIEF DESCRIPTION OF THE DRAWINGS

In the drawings in which reference numerals include corresponding components throughout the views.

DETAILED DESCRIPTION OF THE PREFERRED EMBODIMENT

Figure 1:
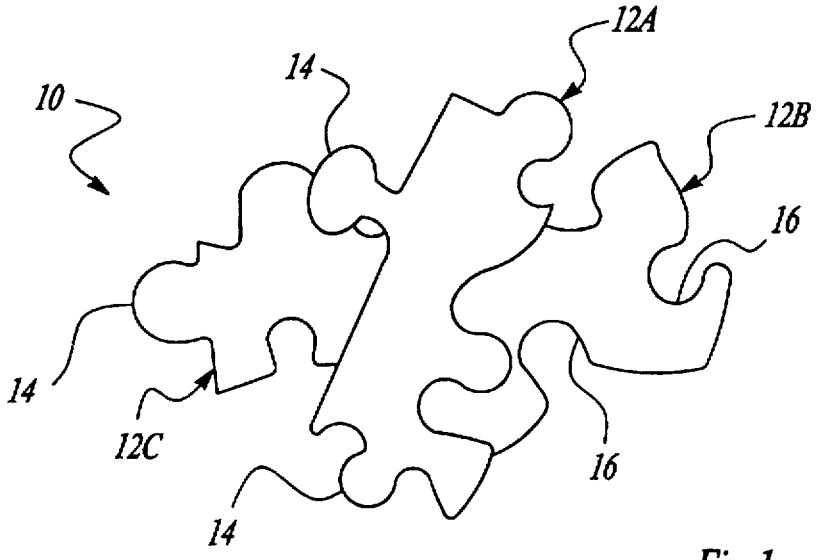
FIG. 1 is a front view of a personal accessory constructed in accordance with a preferred embodiment of my invention.

Referring generally to the drawings in which common reference numerals are used throughout, an exemplary embodiment of a personal accessory constructed in accordance with the teachings of the preferred embodiment of the present invention is identified with reference numeral 10. As will become apparent below, the exemplary embodiment illustrated throughout the drawings is specifically intended to be utilized as an earring. More particularly, the exemplary embodiment illustrated is in the form of an earring of the type which clamps to the ear lobe of an individual. However, it will be appreciated by those skilled in the art that other types of personal accessories are intended to fall within the scope of the present invention. In this regard, the term "personal accessory" shall be understood to mean any type of ornamentation adapted to accessorize a person's clothing, whether it be directly attached to the clothing or suspended from the person (e.g., in the form of an earring).

As shown in the drawings, the personal accessory 10 of the present invention includes a plurality of interlocking members 12. In the exemplary embodiment illustrated, the plurality of interlocking members 12 are three in number and have been designated in the drawings with reference numerals 12A, 12B, and 12C. It will be readily appreciated by those skilled in the art that the subject invention may be modified to include a lesser number of interlocking members 12 or a greater number of interlocking members 12. In large part, the particular number of interlocking members 12 incorporated into a particular design is limited only by designer preference and creativity. As shown in FIG. 1, the portion of the personal accessory 10 which is intended to be visible during use is cooperatively defined by the plurality of interlocking members 12A–12C.

In the preferred embodiment, each of the interlocking members 12A–12C is a piece of a jigsaw puzzle. Thus, each of the interlocking members 12A–12C includes a boundary defined in part by male extensions 14 and female recesses 16. It will be understood by those skilled in the art that the particular jigsaw puzzle pieces 12A–12C chosen for a specific personal accessory design 10 may, but are not intended to interlock with each other. Advantageously, the personal accessory 10 of the present invention can be constructed of used jigsaw puzzles. This provides an inexpensive and readily available source of materials. Additionally, the jigsaw puzzles, which may otherwise be discarded since various pieces may be missing, will be saved from the landfills.

In the exemplary embodiment illustrated, the plurality of interlocking members 12A–12C have been painted to conceal any pre-existing design which may have been included thereon. Painting of the interlocking members 12A–12C enables preparation of the personal accessory 10 to be any color or combination of colors. Alternatively, in certain applications it may be desired for the existing image on the puzzle pieces 12A–12C to remain exposed.

The interlocking members 12A–12C are permanently attached to one another through adhesive or through any other suitable technique. With reference to FIG. 1, the first interlocking member 12A of the exemplary embodiment is positioned in an overlapping relationship with respect to the second and third interlocking members 12B and 12C. The result of such an arrangement is a visually appealing design having an artistic degree of depth.

Figure 2:
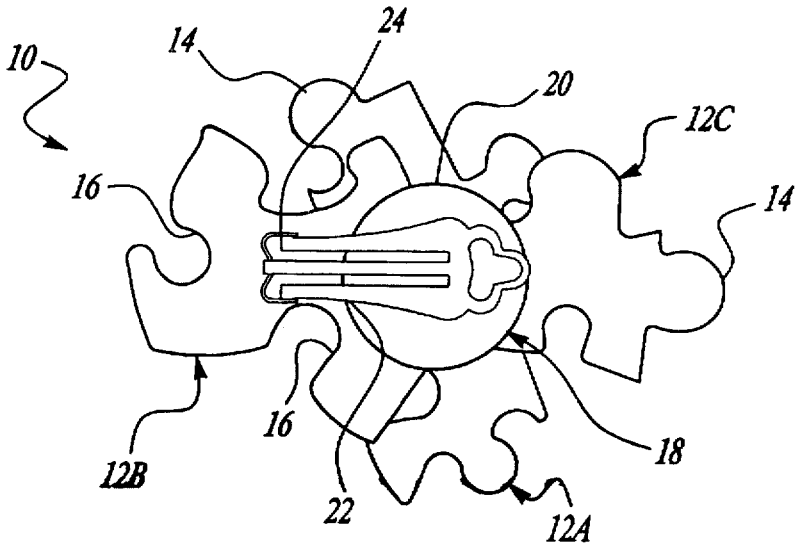
FIG. 2 is a rear view of the personal accessory of FIG. 1.

With reference specifically to FIG. 2, the personal accessory 10 of the present invention is further shown to include means for releasably suspending the personal accessory 10. In the preferred embodiment, the means for releasably suspending the personal accessory is provided in the form of a finding 18. Given the intended application of the personal accessory 10 noted above, the finding 18 is specifically adapted for engaging the earlobe (not shown) of a person. In this regard, the finding 18 is generally of conventional construction and includes a mounting portion 20 permanently affixed to one or more of the plurality of interlocking members 12A–12C and a clasp portion 22 which is pivotally interconnected with the mounting portion 18 through a hinge 24. Again, it will be appreciated by those skilled in the art that alternative types of findings may be employed where different applications for the personal accessory 10 are desired.

With continued reference to FIGS. 1 and 2, the method of the present invention will now be described. In general, the method of the present invention involves the preparation of a personal accessory 10 of the type described immediately above. After interlocking members 12 are selected by the designer of the personal accessory 10, the interlocking members 12 are painted on their front sides to conceal the image carried thereon. Next, the interlocking members 12 are glued or otherwise permanently interconnected. In the preferred method, a first of the interlocking members 12A is oriented in an overlapping manner with respect to a second of the interlocking members 12B and glued thereto. Further, in the preferred embodiment, a third interlocking member 12C is glued to one or both of the first and second interlocking members 12A and 12B. Finally, a finding 18 is attached to the back of one or more of the interlocking members 12A–12C.

The foregoing discussion discloses and describes merely an exemplary embodiment of an apparatus constructed in accordance with the present invention and a related method. One skilled in the art will readily recognize from such discussion and from the accompanying drawings that various changes, modifications and variations can be made thereto without departing from the spirit and scope of the present invention.

What is claimed is:

1. A personal accessory for ornamenting or otherwise accessorizing a person's clothing, the personal accessory comprising:

a first interlocking member;

a second interlocking member fixedly attached to said first interlocking member; and means for releasably suspending the personal accessory, said means for releasably suspending the personal accessory being fixedly attached to at least one of said first and second interlocking members.

2. The personal accessory for ornamenting or otherwise accessorizing a person's clothing of claim 1, wherein said first and second interlocking members are overlapping.

3. The personal accessory for ornamenting or otherwise accessorizing a person's clothing of claim 1, wherein said first and second interlocking members each includes a boundary defined in part by at least one male extension and at least one female recess.

4. The personal accessory for ornamenting or otherwise accessorizing a person's clothing of claim 1, wherein said first and second interlocking members are puzzle pieces.

5. The personal accessory for ornamenting or otherwise accessorizing a person's clothing of claim 4, further comprising a third interlocking member interconnected to said first and second interlocking members.

6. A personal accessory for ornamenting or otherwise accessorizing a person's clothing, the personal accessory comprising:

a first interlocking member;

a second interlocking member fixedly attached to said first interlocking member; and a finding fixedly attached to at least one of said first and second interlocking members.

7. The personal accessory for ornamenting or otherwise accessorizing a person's clothing of claim 6, wherein said first and second interlocking members are overlapping.

8. The personal accessory for ornamenting or otherwise accessorizing a person's clothing of claim 7, wherein said first and second interlocking members each includes a boundary defined in part by at least one male extension and at least one female recess.

9. The personal accessory for ornamenting or otherwise accessorizing a person's clothing of claim 7, wherein said first and second interlocking members are puzzle pieces.

10. The personal accessory for ornamenting or otherwise accessorizing a person's clothing of claim 9, further comprising a third interlocking member interconnected to said first and second interlocking members.

11. A method of constructing a personal accessory for ornamenting or otherwise accessorizing a person's clothing, the method comprising the steps of:

providing a first interlocking member;

providing a second interlocking member;

fixedly attaching said first interlocking member to said second interlocking member; and fixedly attaching a finding to at least one of said first and second interlocking member.

12. The method of ornamenting or otherwise accessorizing a person's clothing of claim 11, further comprising the steps of overlapping said first and second interlocking members.

13. The method of ornamenting or otherwise accessorizing a person's clothing of claim 12, further comprising the step of fixedly attaching a third interlocking member to said first and second interlocking members.

* * * * *